United States Patent [19]

Field

[11] 4,428,357

[45] Jan. 31, 1984

[54] SELF-VENTILATED RANGE AND METHOD OF INSTALLING

[75] Inventor: Thomas R. Field, Noblesville, Ind.

[73] Assignee: Jenn-Air Corporation, Indianapolis, Ind.

[21] Appl. No.: 310,552

[22] Filed: Oct. 13, 1981

[51] Int. Cl.[3] ..... F24C 15/20

[52] U.S. Cl. ..... 126/299 R; 126/300; 126/21 R; 126/299 D

[58] Field of Search ..... 126/21 R, 21 A, 299 R, 126/299 C, 300, 301, 277, 278, 279, 37 R, 39 B, 299 D

[56] References Cited

U.S. PATENT DOCUMENTS 2,525,614 10/1950 Nelson et al. ..... 126/299 R 2,674,991 4/1954 Schaefer ..... 126/299 R 3,596,650 8/1971 Cerola ..... 126/37 R 3,926,171 12/1975 Kurek et al. ..... 126/277

*Primary Examiner*—James C. Yeung

*Attorney, Agent, or Firm*—Richard L. Ward

[57] ABSTRACT

The blower is made separate from the rest of a self-ventilated range and is installed prior to the installation of the range. The blower can be selectively mounted for through-the-wall or through-the-floor discharge and is located so that the hole in the wall or floor misses the studs or joists, respectively. After the blower is installed, the self-ventilated range is set in place over the blower and the blower is connected to the plenum by means of a flexible pipe. In this way the plenum can be made thinner providing more room for the oven cavity.

5 Claims, 7 Drawing Figures

SELF-VENTILATED RANGE AND METHOD OF INSTALLING

BACKGROUND OF THE INVENTION

In some built-in and free standing grill ranges with proximity ventilation, cooking gases and odors are drawn into an inlet grill and are exhausted into the atmosphere. Usually, the air inlet grill is located adjacent the cooking surface and is the inlet to a flow path which serially includes a plenum, a blower and an atmospheric exhaust as well as the interconnecting ductwork. Since the flow path to the atmosphere normally must extend through a wall or floor of the room in which the self-ventilated range is located, the installation of the self-ventilated range normally includes the connection of the self-ventilated range to the rest of the exhaust system. The blower is normally integral with the self-ventilated range and the connection is made with the atmospheric exhaust line either as the self-ventilated range is set in place or after setting the self-ventilated range in place. Obviously, this method of completing the fluid path can cause problems in aligning the members for connection as well as affording a restricted access for making the connection.

SUMMARY OF THE INVENTION

The blower is made a separate unit from the rest of the self-ventilated range and is installed prior to the installation of the rest of the self-ventilated range. The blower is provided with a pair of brackets which permit the selective mounting of the blower to the floor for discharge either through-the-wall or through-the-floor, as required by the installation. Because the blower is installed separately, it can be located for ease of access and to avoid the joists or studs which is a particular problem in retrofit installations. For a through-the-floor exhaust, the blower is secured to the floor with the outlet extending through the floor. However, for a through-the-wall installation, the blower is secured to the floor with the outlet of the blower extending horizontally. The outlet of the blower is connected via a flexible pipe to the external exhaust which extends through the wall. After the blower is secured in place and connected to the atmospheric exhaust, the self-ventilated range is set in place over the blower and connected to the electrical service. The self-ventilated range has a full height plenum which is made thinner to accommodate a full size oven while still providing proximity ventilation of the cooktop. The flow path is completed by connecting the blower and the plenum of the range by means of a length of flexible pipe and the blower is plugged into the self-ventilated range and thereby the electrical system of the self-ventilated range.

It is an object of this invention to provide a method and apparatus for connecting the exhaust line of a proximity ventilation system that adjusts to the existing studs or joists.

It is a further object of this invention to provide a self-ventilated range having a blower that can be selectively mounted for either vertical or horizontal discharge.

It is an additional object of this invention to reduce cabinet vibrations and noise.

It is a yet still further object of this invention to provide additional volume for the oven cavity in a proximity ventilation range. These objects, and others as will become apparent hereinafter, are accomplished by the present invention.

Basically, the blower is separate from the rest of the self-ventilated range and is adapted to be selectively secured to the floor in a position for through-the-floor or through-the-wall exhaust to atmosphere, as required by the installation. For a through-the-wall exhaust, the outlet of the blower is connected to the atmospheric exhaust via a flexible pipe. The self-ventilated range is then set in place over the installed blower and the blower is connected to the plenum by means of a flexible pipe and the blower is plugged into the electrical system of the self-ventilated range which is connected to the electrical service in a conventional manner.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
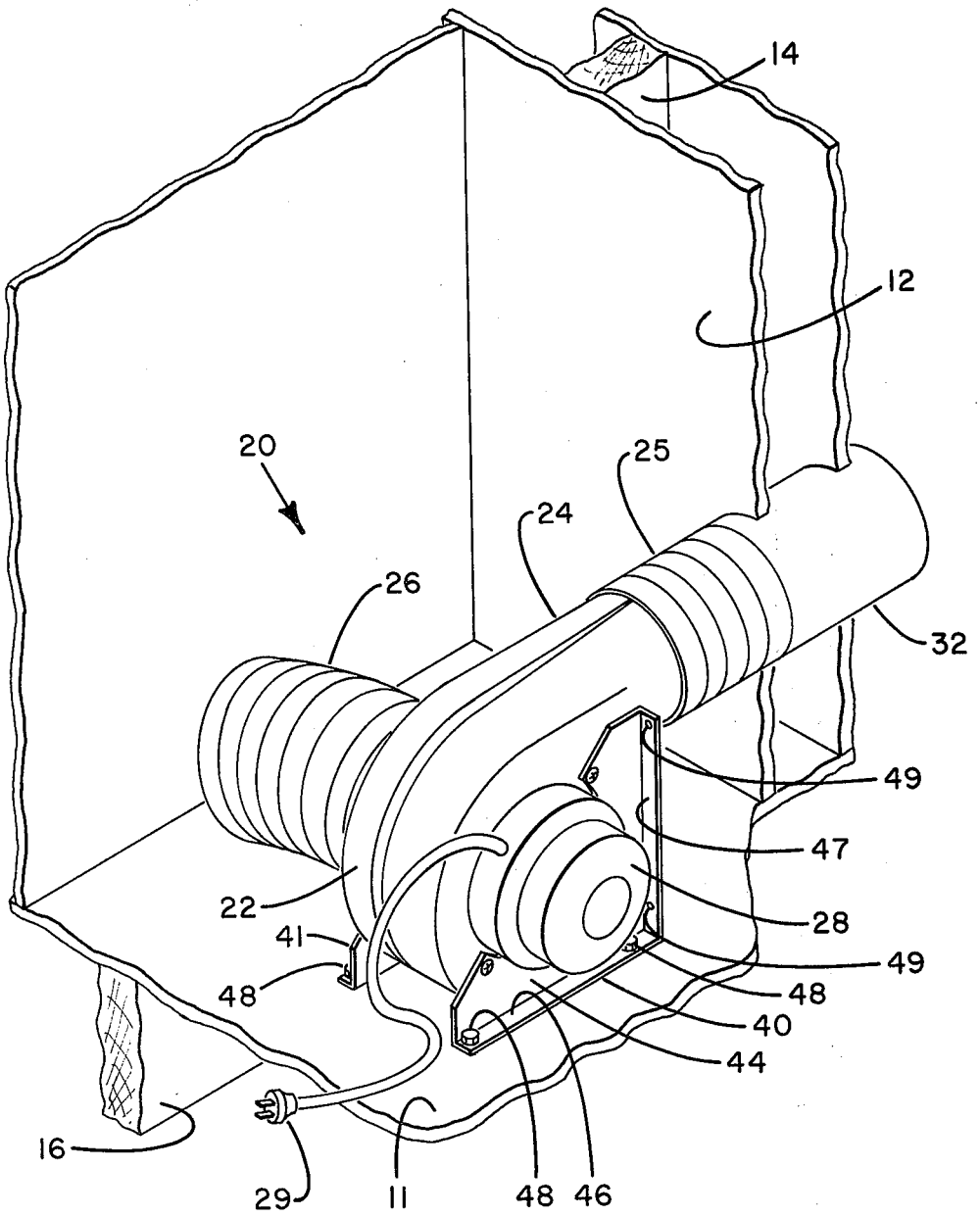
FIG. 1 is a pictorial view of a blower installed according to the teachings of the present invention.

In FIG. 1, the numeral 20 generally designates a blower which has been installed according to the teachings of the present invention. The blower 20 includes a scroll 22 which terminates in a tangential outlet 24 and is held in place by brackets 40 and 41 which are identical but for the fact that they are opposite handed. Since bracket 40 is best illustrated, only bracket 40 will be described but the description is applicable to bracket 41. Bracket 40 is made up of a vertical portion 44 and two foot portions, 46 and 47, which are at right angles to portion 44 and to each other and are essentially equally spaced from the axis of the inlet of the blower whereby bracket 40 may be placed with either foot portion 46 and 47 engaging floor 11 while maintaining essentially a constant alignment of the plenum outlet and blower inlet. However, since blower outlet 24 extends beyond the plane of foot portion 47 it would therefore extend through the floor 11 if blower 20 is placed with foot portion 47 engaging floor 11.

When installing the blower 20 in a through-the-wall position, as illustrated, a hole is made through wall 12 to accommodate the outlet pipe 32. It should be noted that the choice of the location of the hole in wall 12 is made with reference to the location of studs 14 and to a lesser degree to the chosen location of blower 20. The studs can be located in a conventional manner. The location chosen for the blower will be made with respect to the location of outlet pipe 32, the plenum 60 and the joists 16. The joists can be located in a conventional manner. Because blower 20 is connected to outlet pipe 32 by means of flexible pipe 25 and to plenum 60 by means of flexible pipe 26, there is considerable flexibility in positioning blower 20 so that the blower can be secured to the joists 16, or not, as desired. This flexibility of positioning also permits the maintaining of sufficient clearances between the members to facilitate installation. To the extent possible, however, a straight line run is desired to minimize flow resistance. As illustrated, screws 48 extend through holes 49 in foot portion 46 of the bracket 40 and are screwed into the floor 11. Bracket 41 would be similarly secured. With blower 20 secured to floor 11 and with outlet pipe 32 in place, flexible pipe 25 is set in place to connect outlet 24 with outlet pipe 32. Flexible pipe 26 is set in place on inlet 23 of blower 20. The blower 20 will then appear as illustrated in FIG. 1. Alternatively, flexible pipe 26 can be installed after the self-ventilated range is set in place.

Figure 2:
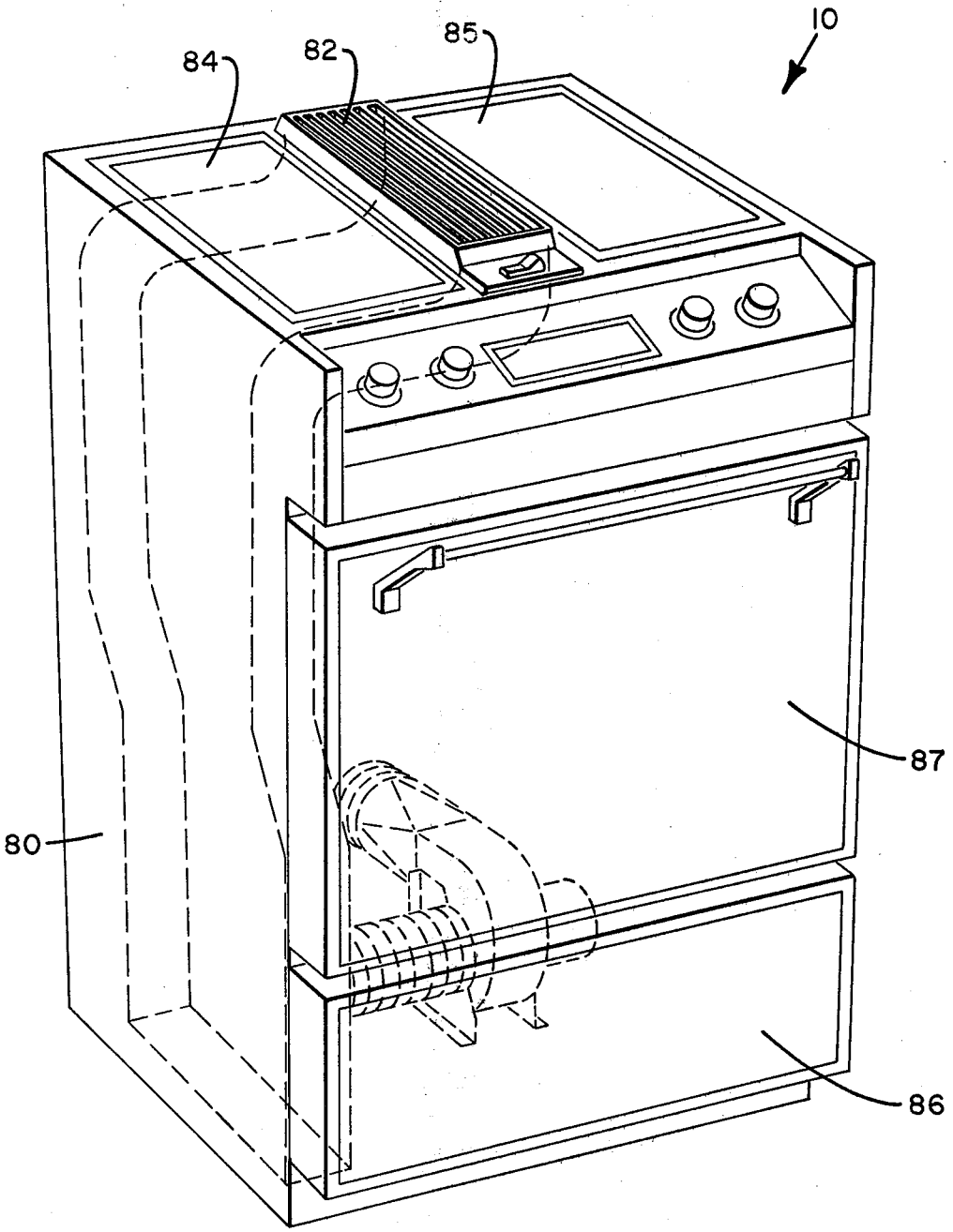
FIG. 2 is a pictorial view of a self-ventilated range employing the present invention.
Figure 3:
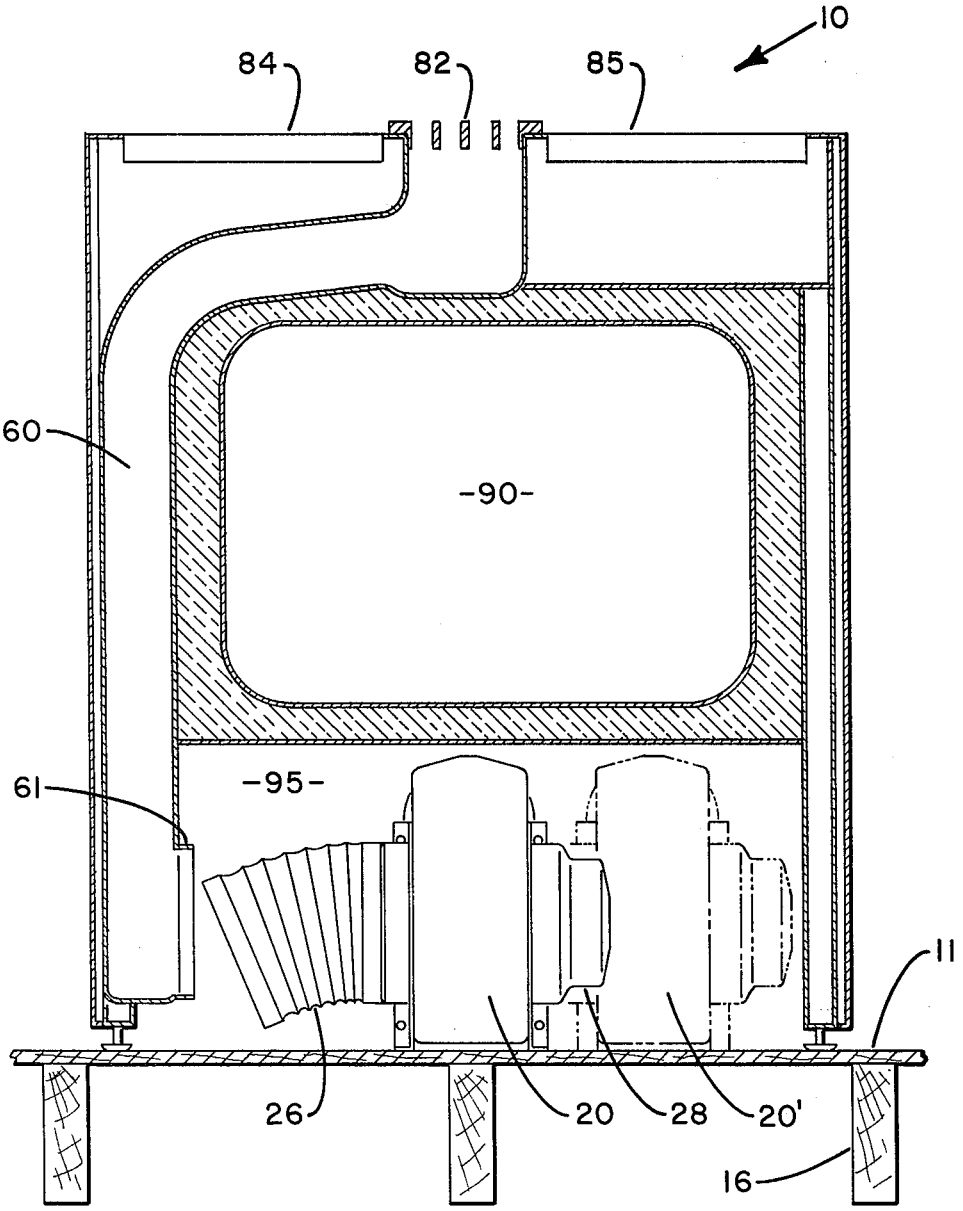
FIG. 3 is a sectional view of the self-ventilated range of the present invention.

The cabinet 80 of the self-ventilated range 10 will then be set in place over the blower 20 and the self-ventilated range will be connected to the electrical service in a conventional manner. The self-ventilated range 10 is best shown in FIG. 2 where the inlet grill 82 to the proximity ventilation system is located in the top of range 10 between interchangeable cooktops 84 and 85. Access door 86 which is located below oven door 87 replaces the normal utensil drawer and serves to provide the necessary access for connecting the flow path according to the teachings of the present invention. The major portion of the proximate ventilation system is shown in phantom lines in FIG. 2. After range 10 is set in place, the access door 86 is opened to permit easy access to ventilation chamber 95, as is best shown in FIG. 3, for connecting flexible pipe 26 to the outlet 61 of the plenum 60 to thereby complete the exhaust flow path between inlet grill 82 and outlet pipe 32. Since blower 20 is firmly secured to the floor 11 and is physically connected to the rest of the range only by flexible pipe 26, vibration and noise is minimized. Blower 20' which is drawn in phantom lines shows an alternative position of the blower 20 afforded by the present invention. The chamber 95 is open at the back and bottom so that the range 10 may be set or slid over the previously installed blower 20. Motor 28 of the blower 20 is enabled by plugging plug 29 into the self-ventilated range's electrical system.

Figure 4:
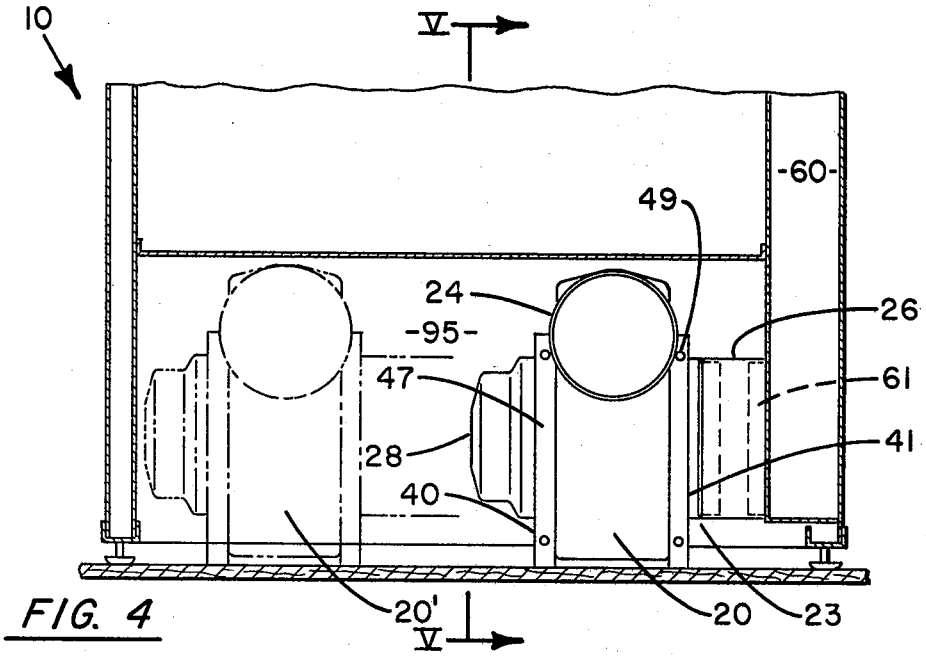
FIG. 4 is a partial rear view of a self-ventilated range exhausting through a wall.
Figure 5:
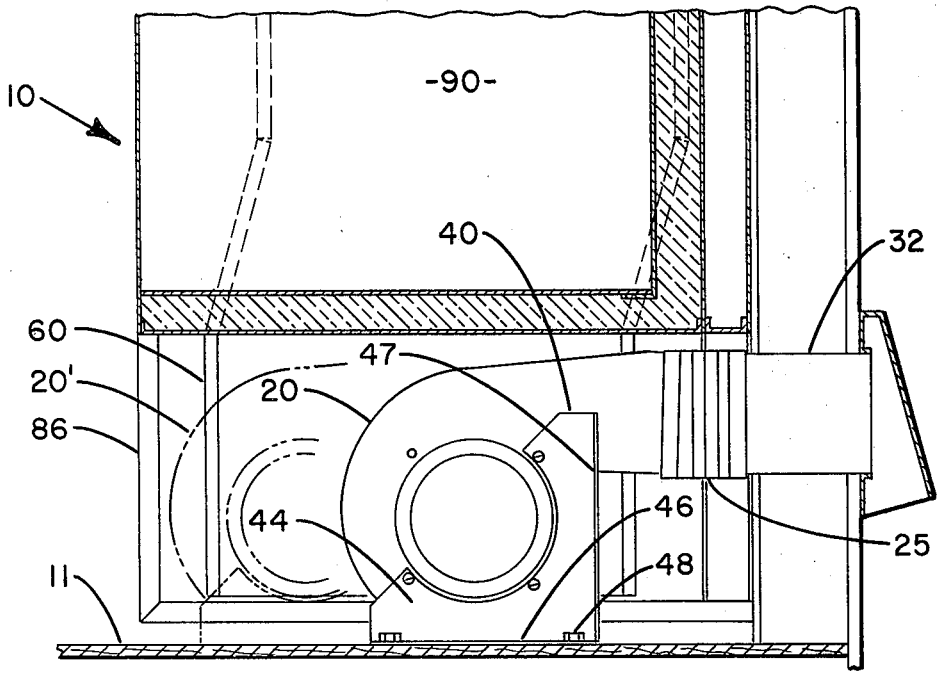
FIG. 5 is a sectional view taken along line V—V of FIG. 4.

The completely installed, horizontally exhausting blower 20 is best shown in FIGS. 4 and 5. By making the blower 20 separate, the plenum 60 can then be extended to the full vertical extent of the range 10, and the necessary plenum volume can be obtained while permitting a wider oven cavity 90. The blower 20 can be located just about anywhere within the cavity 95 with the only practical limitations being the ease of connecting the blower 20 to the outlet pipe 32 via flexible pipe 25 and the connecting of blower 20 to plenum 60 via flexible pipe 26 together with the avoidance of studs and joists. Blower 20', drawn in phantom, indicates the range of available positions for blower 20. However, as noted above, all pipe runs are preferably straight to minimize losses which can become critical on long runs.

Figure 6:
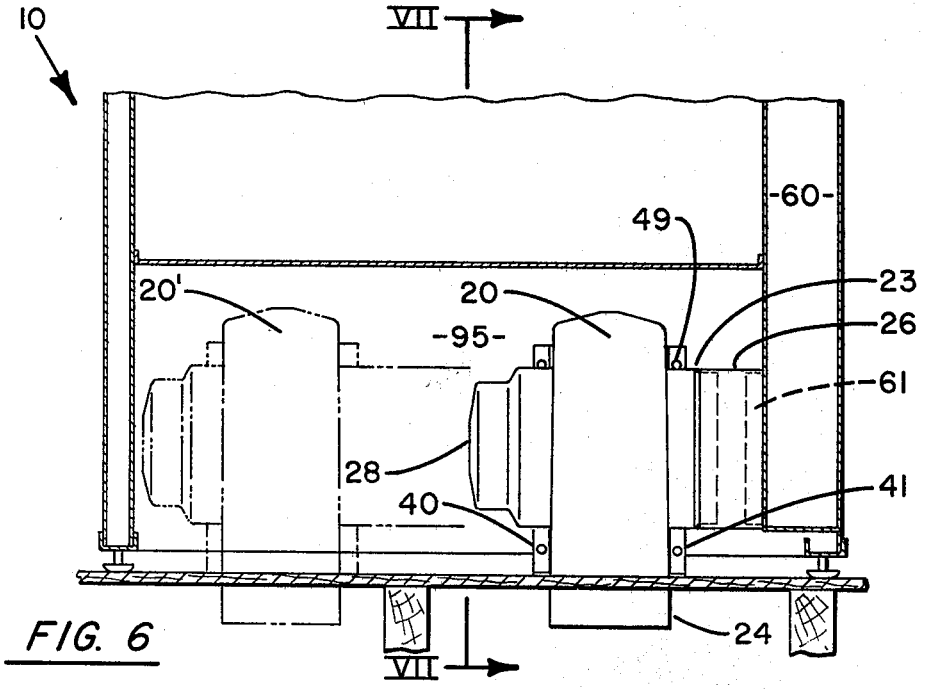
FIG. 6 is a partial rear view of a self-ventilated range exhausting through a floor.
Figure 7:
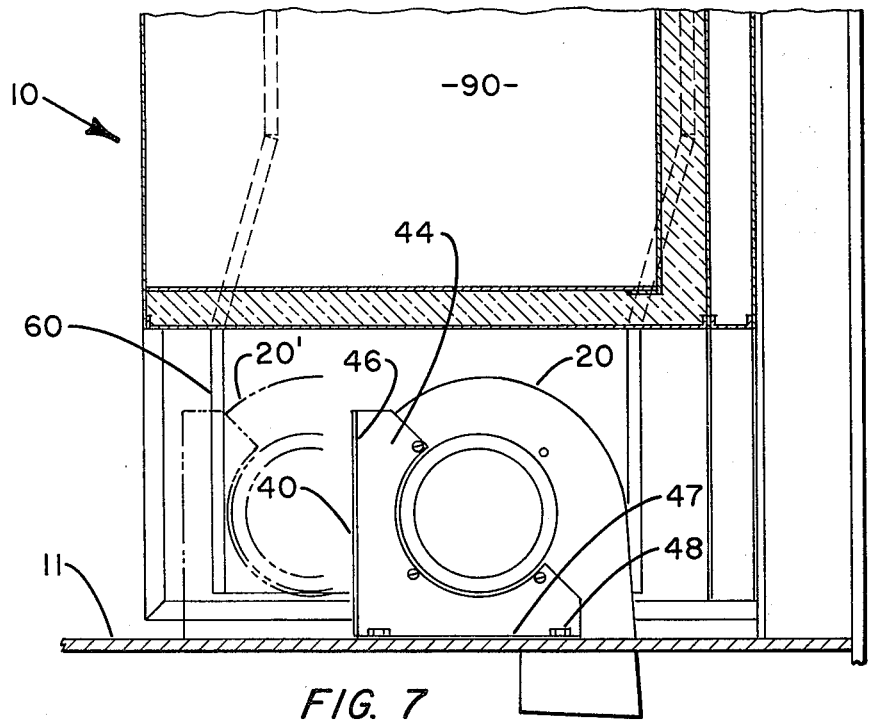
FIG. 7 is a sectional view taken along line VII—VII of FIG. 6.

In FIGS. 1–5, the blower 20 is oriented for a horizontal or through-the-wall exhaust. However, blower 20 can be oriented for a vertical or through-the-floor exhaust as is illustrated in FIGS. 6 and 7. In the FIGS. 6 and 7 position, foot portion 47 of bracket 40 is secured to floor 11 by screws 48 and blower outlet 24 extends through a hole in the floor 11 and is connected into the exhaust line (not illustrated) beneath the floor without reference to the presence or absence of range 10. The blower location is essentially dictated by the joist locations with alternative blower positions are indicated by blower 20'. After range 10 is put in place over blower 20, flexible pipe 26 is placed to connect blower inlet 23 and plenum outlet 61 as in the arrangement of FIGS. 1–5.

From the above explanation, it follows that by securing blower 20 to the floor 11 and by connecting the blower 20 to the range only through the flexible pipe 26, the blower motor vibrations are not transmitted to the cabinet of range 10 which results in a quieter operation. By separating blower 20 from the range 10, the plenum can be made higher and thinner which results in more room for the oven cavity. Finally, by providing the brackets 40 and 41 with two feet and connecting the blower by flexible pipes, the orientation of the discharge of the blower can be vertical or horizontal and the blower can be located wherever convenient with reference to access and the stud and joist locations.

Although a preferred embodiment of the present invention has been illustrated and described, other changes will occur to those skilled in the art. It is therefore intended that the scope of the present invention is to be limited only by the scope of the appended claims.

What is claimed is:

1. A self-ventilated range comprising:

a blower means adapted to be secured to a floor and having an inlet and an outlet which is adapted to be connected to an atmospheric exhaust;

a bracket means associated with said blower means for selectively securing said blower means to said floor in one of a first mode with said blower means outlet directed for discharge through-the-wall and a second mode with said outlet directed for discharge through-the-floor to said atmospheric exhaust;

a cabinet means having a top surface and defining a ventilation cavity which is open at the back and bottom whereby said cabinet means is adapted to be set in place over said blower means when said blower means is secured to a floor so that said blower means is located in said ventilation cavity;

an oven means located in said cabinet means;

at least one cooking unit adapted to be located in said top surface of said cabinet means;

a proximity ventilation inlet grill located in said top surface of said cabinet means adjacent said cooking unit;

a plenum means located in said cabinet means and extending essentially the full height of said cabinet means and providing a fluid path from said inlet grill to a plenum outlet which leads to said ventilation cavity;

access door means forming the front of said ventilation cavity and being adapted to open to provide access to said ventilation cavity;

fluid connecting means for connecting said inlet of said blower means to said plenum outlet when said cabinet means is set in place over said blower means and said access door means is open to establish a proximity ventilation flow path which serially includes said inlet grill, said plenum means, said fluid connecting means and said blower means for discharge to said atmospheric exhaust.

2. The self-ventilated range of claim 1 wherein said blower means is adapted to be selectively installed for either a through-the-wall or a through-the-floor discharge and further comprising:

a scroll with said inlet being axially located on one side and said outlet being tangential to said scroll;

said bracket means including a pair of brackets respectively secured to said one side and a second side which is opposite said one side;

each of said brackets having a vertical portion and first and second foot portions all of which are at right angles to each other with said first and second foot portions being adapted to receive securing means for securing said scroll in place;

a first plane defined by said first foot portions of said pair of brackets and a second plane defined by said second foot portions of said pair of brackets being essentially the same perpendicular distance from the axis of said inlet with said first plane being essentially parallel to the axes of said inlet and outlet; and said outlet extending beyond said second plane whereby when said blower means is supported on a floor on said first foot portions said outlet is horizontally oriented for a through-the-wall discharge and when said blower means is supported on a floor on said second foot portion said outlet is downwardly directed and extends beyond said floor for a through-the-floor discharge.

3. A self-ventilated range comprising:

a blower means adapted to be secured to a floor and having an inlet and an outlet which is adapted to be connected to an atmospheric exhaust, said blower means further having a scroll with said inlet being axially located on one side and said outlet being tangential to said scroll;

a pair of brackets respectively secured to said one side and a second side of said blower means which is opposite said one side;

each of said brackets having a vertical portion and first and second foot portions all of which are at right angles to each other with said first and second foot portions being adapted to receive securing means for securing said scroll in place;

a first plane defined by said first foot portions of said pair of brackets and a second plane defined by said second foot portions of said pair of brackets being essentially the same perpendicular distance from the axis of said inlet with said first plane being essentially parallel to the axes of said inlet and outlet;

said outlet extending beyond said second plane whereby when said blower means is supported on a floor on said first foot portions said outlet is horizontally oriented for a through-the-wall discharge and when said blower means is supported on a floor on said second foot portion said outlet is downwardly directed and extends beyond said floor for a through-the-floor discharge;

a cabinet means having a top surface and defining a ventilation cavity which is open at the back and bottom whereby said cabinet means is adapted to be set in place over said blower means when said blower means is secured to a floor so that said blower means is located in said ventilation cavity;

an oven means located in said cabinet means;

at least one cooking unit adapted to be located in said top surface of said cabinet means;

a proximity ventilation inlet grill located in said top surface of said cabinet means adjacent said cooking unit;

a plenum means located in said cabinet means and extending essentially the full height of said cabinet means and providing a fluid path from said inlet grill to a plenum outlet which leads to said ventilation cavity;

access door means forming the front of said ventilation cavity and being adapted to open to provide access to said ventilation cavity; and fluid connecting means for connecting said inlet of said blower means to said plenum outlet when said cabinet means is set in place over said blower means and said access door means is open to establish a proximity ventilation flow path which serially includes said inlet grill, said plenum means, said fluid connecting means and said blower means.

4. A self-ventilated range comprising:

cabinet means having a top surface, an oven, at least one cooking unit located in said top surface, a proximity ventilation inlet grill located in said top surface adjacent said cooking unit, and plenum means extending essentially the full height of said cabinet means and providing an airflow path from said inlet grill to a lower plenum opening, and a ventilation cavity subjacent said oven and open at the front, bottom and rear;

blower means having an inlet adapted to be connected to said plenum opening and an outlet which is adapted to be connected to an atmospheric exhaust and including bracket means for selectively and independently securing said blower means to a floor within said ventilation cavity in a first mode for directing said outlet through-the-wall or in a second mode for directing said outlet through-the-floor to said atmospheric exhaust; and access door means for closing the front opening of said cabinet means ventilation cavity and for providing access thereto, said cabinet means being separable from said blower means by opening said access door means and disconnecting said blower means inlet from said plenum opening whereby said cabinet means is removable from an installation site without removing said blower means.

5. In the installation of a self-ventilated range for cooking food wherein a cabinet supports cooking units on the upper surface thereof and encloses an oven and a proximity ventilation system including a plenum, a blower having mounting brackets for securing the blower to a floor in a plurality of modes with the blower operable for drawing particulate laden air from above the upper surface, through the plenum and exhausting either through-the-wall or through-the-floor, the method of assembling the parts that comprise the steps of:

securing the blower in one of the plurality of modes through the mounting brackets so that the outlet thereof is directed either rearwardly or downwardly;

connecting an atmospheric exhaust to the blower outlet;

placing the cabinet with the proximity ventilation system over the secured blower; and connecting the inlet of the blower with the plenum of the proximity ventilation system to serially arrange the proximity ventilation system, blower and atmospheric exhaust.

* * * * *